US005266264A

United States Patent [19]

Miura et al.

[11] Patent Number: 5,266,264

[45] Date of Patent: Nov. 30, 1993

[54] PROCESS FOR PRODUCING SINTERS AND BINDER FOR USE IN THAT PROCESS

[75] Inventors: Ritsu Miura; Hirokazu Madarame; Masahiro Uchida; Yasushi Owaki, all of Chiba, Japan

[73] Assignee: The Japan Steel Works Ltd., Tokyo, Japan

[21] Appl. No.: 815,184

[22] Filed: Dec. 31, 1991

[51] Int. Cl.[5] ..... B22F 3/12

[52] U.S. Cl. ..... 419/37; 419/38; 419/53; 419/57

[58] Field of Search ..... 419/36, 37, 38, 53, 419/57, 65

[56] References Cited

U.S. PATENT DOCUMENTS

| | | | |
|---|---|---|---|
| 4,721,599 | 6/1988 | Nakamura | 419/23 |
| 4,948,426 | 8/1990 | Kato et al. | 419/23 |
| 4,956,012 | 9/1990 | Jacobs et al. | 75/236 |
| 5,059,387 | 10/1991 | Brasal | 419/23 |
| 5,067,979 | 11/1991 | Kiyota et al. | 75/243 |

FOREIGN PATENT DOCUMENTS 64-28303 1/1989 Japan .

*Primary Examiner*—Donald P. Walsh
*Assistant Examiner*—Daniel Jenkins
*Attorney, Agent, or Firm*—Sughrue, Mion, Zinn, Macpeak & Seas

[57] ABSTRACT

The present invention relates to a process for producing sinters, including a steps of mixing a powder material with a binder, injection molding the mixture, and then dewaxing and sintering the resulting injection molded article, wherein the binder comprises at least one of: copolymer, a mixture of copolymer, paraffine wax, carnauba wax, a mixture of the paraffine wax and the carnauba wax, a plasticizer, and a lubricant. According to the present invention, the dewaxing step comprises heating the injection molded article to a temperature of 250°-500° C. in a heating rate of 5°-100° C./hour under the pressure not higher than 1 Torr in order to remove 40%-95 % by weight of the binder components. Further, the temperature elevation in the sintering step is started in a vacuum atmosphere and replacing the atmosphere with an inert gas atmosphere in the process of temperature elevation.

9 Claims, 2 Drawing Sheets

PROCESS FOR PRODUCING SINTERS AND BINDER FOR USE IN THAT PROCESS

BACKGROUND OF THE INVENTION

This invention relates to a process for producing sinters. More particularly, it relates to a process which comprises mixing a metal or ceramic powder with a binder that contains a thermoplastic resin and wax as main components, injection molding the mixture, dewaxing the molded article (removal of binder) and sintering the dewaxed article, whereby sinters of a highly precise and three-dimensionally complex shape can be produced in large quantities.

It is known to produce metal or ceramic sinters by a process that comprises mixing the starting powder with a thermoplastic binder, shaping the mixture, dewaxing the shaped article (removing the binder) and sintering the dewaxed article. If sinters having a complex three-dimensional shape need to be produced with high dimensional precision, the shaped article is conventionally dewaxed as it is buried in inert powders such as those of ceramics (e.g. alumina) so as to prevent the shaped article from deforming or cracking during the dewaxing (thermal dewaxing). However, this dewaxing method is not practical for commercial applications since it is very difficult to remove ceramic and other inert powders from the surface because of the fragility of the dewaxed article.

Therefore, a first object of the present invention is to provide a binder that can be removed from a shaped article of the starting powder and said binder without causing deformation or cracking even if the article is not buried in an inert powder, as well as a process for producing a sinter using that binder.

The atmosphere for sintering shaped metal powders is generally selected from among reducing atmospheres (e.g. hydrogen gas and dissociated ammonia gas) or inert atmospheres (e.g. argon, helium and vacuo) depending upon the type of metal powder to be used. Particularly in the case of metals or alloys such as stainless steel that are subject to deterioration in performance such as corrosion resistance or mechanical properties on account of carbon pickup (carburization) from molding aids (e.g. binders and lubricants), it is conventional to perform sintering under vacuum so as to remove carbon by making use of the following reaction:

$$C + MO \text{ (metal oxide in the metal powder)} \rightarrow M + CO.$$

However, the sintering under vacuum involves metal evaporation from the shaped article at elevated temperature and this makes it very difficult to achieve close control on the dimensional precision of the final product. Since the amount of metal evaporation depends on both temperature and the degree of vacuum, nonuniformity in the temperature in the sintering furnace or the inter-batch differences in the furnace temperature and the degree of vacuum will cause variations in the dimensions of the sinter. Further, the ultimate pressure in the vacuum sintering furnace will depend on the number of samples to be charged and is usually difficult to control in a precise manner.

Therefore, a second object of the present invention is to provide a sintering method by which sinters of high dimensional precision can be manufactured from metals and alloys such as stainless steel that inherently are subject to deterioration in performance such as corrosion resistance or mechanical properties on account of carbon pickup from molding aids (e.g. binders and lubricants).

When metal or ceramic sinters are produced from injection molded articles by a process including dewaxing and sintering steps, it is conventional to perform the dewaxing step in an air or an inert gas atmosphere under atmospheric or pressurized condition but this step has not been practiced in vacuo in order to prevent blistering.

When dewaxing the shaped article in an air or an inert gas atmosphere under atmospheric or pressurized condition, the decomposed gas of the binder will stay around the injection molded article to react with the binder component remaining in the latter, thereby causing unwanted deformation. Under the circumstances, a plurality of shaped articles must be charged into the dewaxing furnace with the distance between adjacent articles being kept sufficiently large to avoid the possible deformation of the articles. However, this has limited the amount of shaped articles that can be charged into the furnace. In addition, deformation, cracking or blistering will occur at rapid heating rate, so the temperature in the furnace must be raised at a slow rate of 1°-5° C./h but this has prolonged the time necessary to complete the dewaxing of the shaped article.

With a view to achieving dewaxing at a faster speed, Unexamined Published Japanese Patent Application No. 28303/1989 proposed that an injection molded article comprising a magnetic alloy powder and a thermoplastic resin be dewaxed in a vacuum atmosphere. However, the vacuum dewaxing method disclosed in that patent involves temperature elevation at such a high rate of 2°-10° C./min that if it is applied to the purpose of dewaxing an injection molded article comprising a metal or ceramic powder and a conventional binder, blistering, deformation or cracking will occur, making it impossible to accomplish mass-production of sinters having high dimensional precision.

Therefore, a third object of the present invention is to provide a process for producing sinters that is free from the aforementioned problems of the prior art.

SUMMARY OF THE INVENTION

According to its first aspect, the present invention relates to a binder for use in powder forming which comprises at least one of: 5%-40 % by weight of an ethylene-vinyl acetate copolymer (EVA), an ethylene-ethyl acrylate copolymer (EEA), or a mixture thereof; 5%-40 % by weight of a polypropylene (PP), an atactic polypropylene (APP) or a mixture thereof; 5%-40 % by weight of a polystyrene (PS), a polyethylene (PE), or mixture thereof; and 20%-70 % by weight of paraffin wax, carnauba wax, or mixture thereof.

This binder may optionally contain either a plasticizer or a lubricant or a mixture thereof in an amount of less than 15 % by weight.

According to its second aspect, the present invention relates to a process for producing a high-precision sinter by shaping a powder material and then sintering the same, which process is characterized in that temperature elevation in the sintering step is started in a vacuum atmosphere, which is replaced by an inert gas atmosphere in the process of temperature elevation.

According to its third aspect, the present invention relates to a process for producing a sinter, comprising the steps of: mixing a powder material with a binder; injection molding the mixture to obtain a injection molded article; dewaxing the injection molded article;

and sintering the resulting dewaxed article, wherein the temperature elevation in the sintering step is started in a vacuum atmosphere and replacing the atmosphere with an Ar gas atmosphere in the process of temperature elevation. In addition, according to the third aspect of the present invention, the binder comprises at least one of: 5%–40% by weight of an ethylene vinyl acetate copolymer (EVA), an ethylene-ethyl acrylate copolymer (EEA), or a mixture thereof; 5%–40% by weight of a polypropylene (PP), an atactic polypropylene (APP), or a mixture thereof; 5%–40% by weight of a polystyrene (PS), a polyethylene (PE), or mixture thereof; 20%–70% by weight of paraffin wax, carnauba wax, or a mixture thereof; and less than 15% by weight of a plasticizer selected from diethyl phthalate (DEP), dibutyl phthalate (EBP) and dioctyl phthalate (DOP), a lubricant selected from stearic acid and oleic acid, or mixture of the plasticizer and the lubricant. Further, according to the third aspect of the present invention, the dewaxing process is characterized in that the injection molded article is heated to a temperature of 250°–500° C. in a heating rate of 5°–100° C./h under the pressure not higher than 1 Torr in order to remove 40%–95% by weight of the binder components.

DETAILED DESCRIPTION OF THE INVENTION

Figure 1:
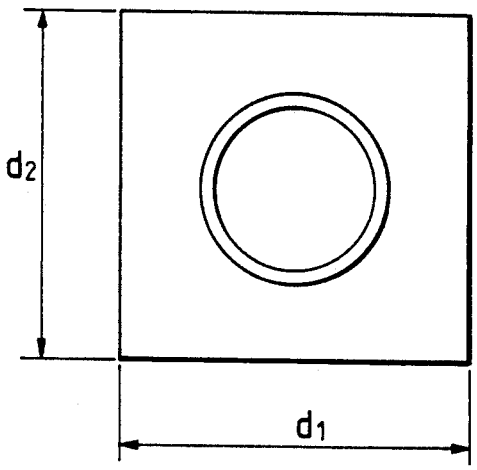
FIG. 1 is a front view of the injection molded article prepared in Examples 1–4.

According to the present invention, the binder contains as a first component 5–40 wt % of either an ethylene-vinyl acetate copolymer (EVA) or an ethylene-ethyl acrylate copolymer (EEA) or both. EVA and EEA are thermoplastic resins; since they have good flowability under heating, they can impart good moldability to a mixture to be shaped that consists of the starting powder and the binder. Further, they enhance the strength of the shaped article and this effect, combined with their high heat stability, insures that the shaped article will retain its shape even if the other components are decomposed away at low temperature during vacuum dewaxing.

If the addition of EVA and/or EEA is less than 5 wt %, they will not exhibit the intended effect. If their addition exceeds 40 wt %, a large volume of decomposition gas will form during dewaxing, occasionally causing the shaped article to blister or crack; the decomposition gas might also remain in the sinter to deteriorate its characteristics.

The binder to be used in the process of the present invention also contains 5–40 wt % of either polypropylene (PP) or atactic polypropylene (APP) or both. Like the aforementioned EVA and EEA, PP and APP as the second component are thermoplastic resins and have similar actions. However, they are more viscous than EVA and EEA and contribute to a higher strength of the shaped article. In addition, PP and APP have higher softening points and this makes them particularly effective in retaining the shape of the shaped article during dewaxing.

As in the case of EVA and EEA, PP and/or APP are ineffective if their addition is less than 5 wt %. If their addition exceeds 40 wt %, the flowability of the mixture being shaped will deteriorate. If a higher shaping temperature is adopted with a view to improving the flowability of the mixture, the other binder components that have lower thermal decomposition temperatures will evaporate.

The binder to be used in the process of the present invention further contains 5–40 wt % of either polystyrene (PS) or polyethylene (PE) or both as a third component. PS and PE are also thermoplastic resins but they will soften at temperatures between the softening points of EVA and EEA and those of PP and APP. When those resins are present in admixture, the thermal decomposition of the binder will slowly proceed during dewaxing, thereby preventing the shaped article from deforming, cracking or blistering that would otherwise take place if the binder were subjected to rapid thermal decomposition. Among resinous binder components, PS has a particularly good dewaxing property and is effective in dewaxing the shaped article without causing deformation due to its softening.

If the addition of PS and/or PE is less than 5 wt %, they will not exhibit the intended effect. If their addition exceeds 40 wt %, the same results will occur as in the case where more than 40 wt % of EVA and/or EEA is used. Further, PS is poor in tackiness and its excessive addition may deteriorate the strength of the shaped article.

The binder to be used in the process of the present invention contains 20–70 wt % of either paraffin wax or carnauba wax or both as a fourth component. Paraffin wax and carnauba wax not only enhance the flowability of the mixed compound during shaping but also improve the wettability of the starting powder with the binder so as to insure that the starting powder will be dispersed uniformly in the shaped article. Further, paraffin wax and carnauba wax have a different dewaxing mechanism than the aforementioned resinous binder components, in that they diffuse through the shaped article during dewaxing to reach its surface, from which they will evaporate into atmosphere. Since they form passageways through which the resinous binder components as decomposed into gases will diffuse to go outside of the shaped article, the shaped article can be effectively dewaxed without damage. Carnauba wax has a comparatively high strength at low temperature among the waxy binders and, at the same time, they have relatively high melting points; hence, carnauba wax is effective for the purpose of retaining the shape of the shaped article. If the addition of paraffin wax and/or carnauba wax is less than 20 wt %, they will not exhibit their intended effect. If the addition of those waxes exceeds 70 wt %, their low tackiness deteriorates the moldability of the mixture and the shape retention of the shaped article being dewaxed will deteriorate to cause its deformation.

The binder to be used in the process of the present invention further contains either a plasticizer or a lubricant or both in an amount of up to 15 wt %.

Examples of the plasticizer that can be used include diethyl phthalate (DEP), dibutyl phthalate (DBP) and dioctyl phthalate (DOP). The plasticizer improves the miscibility of the aforementioned first to fourth components of the binder for not only homogenizing the latter but also improving the flowability of the mixed compound being shaped. The aforementioned examples of the plasticizer may be used either independently or as admixtures.

Examples of the lubricant that can be used include stearic acid and oleic acid. If the release of the shaped article from the mold is not very good, the lubricant can also be used as a release agent. The aforementioned examples of the lubricant may be used either independently or as admixtures.

If the addition of the plasticizer and/or lubricant is 15 wt % and above, the strength of the shaped article will decrease to cause occasional deformation during subsequent dewaxing.

The binder formulated in the manner described above can advantageously be used in producing sinters from injection molded articles of various starting powders including metal powders such as alloy powders (e.g. stainless steel powder, Fe-Si powder and Fe-Ni powder ) and pure metallic powder (e.g. Fe and Cu powder), and ceramic powders such as alumina and zirconia powders. One advantage of using the above-described binder for powder shaping is that the shaped article of a mixture of the starting powder and the binder can be subsequently dewaxed without embedding it in an inert powder as has heretofore been practiced to prevent the occurrence of cracking or deformation in the shaped article. As a result, the need for subsequent removal of the inert powder from the surface of the dewaxed shaped article is eliminated and this contributes to a substantial simplification of the overall process of producing sinters.

In the process for producing sinters using the aforementioned binder for powder shaping, the steps of mixing, shaping and sintering may be performed by straightforward application of conventional procedures; however, the binder will prove particularly effective in the case where the dewaxing step is performed in vacuo. If the binder under consideration is subjected to vacuum dewaxing, much better results are attained than when the conventionally used binders are subjected to vacuum dewaxing and sinters of high dimensional precision having three-dimensionally complex shapes can be mass-produced from the injection molded articles of metal and ceramic powders without experiencing any deformation or cracking.

According to its second aspect, the present invention provides a process in which a shaped metal powder is heated with a sintering furnace in a vacuum atmosphere and, at a temperature at which the CO gas reaction proceeds to a sufficient extent to have the carbon content of the shaped article lowered to a desired level and below, the sintering atmosphere is replaced by an argon or some other inert gaseous atmosphere, followed by further sintering in that inert atmosphere. In a preferred embodiment, an injection molded article that has been dewaxed under vacuum is sintered in such a way that temperature elevation is started in a vacuum atmosphere, which is then replaced by an Ar gas atmosphere in the course of temperature elevation. Shifting from the vacuum sintering atmosphere to the Ar gas atmosphere can be effected in the temperature range of 1050°-1300° C. as temperature elevation is performed in the vacuum atmosphere. The temperature for the shifting can be selected as appropriate for various conditions including the dimensional precision of the sinter to be produced and its carbon content.

According to the above-described procedure, the injection molded article which has been dewaxed under vacuum is heated in the vacuum atmosphere and the CO gas reaction is allowed to proceed to a sufficient extent to have the carbon content of the shaped article lowered to a desired level and below, whereupon the sintering atmosphere is replaced by Ar gas atmosphere so as to prevent the evaporation of any of the aforementioned components of the shaped article, whereby the dimensional nonuniformity of the resulting sinters can be reduced to insure that sinters of high dimensional precision are mass-produced on an industrial scale.

Dewaxing under vacuum that is performed in accordance with the third aspect of the present invention offers the following advantages. The waxy component which has a comparatively low melting point (40-100° C.) among the binder components becomes liquid at its melting point and above and diffuses between individual particles in the shaped powder under vacuum to reach the surface of the shaped article, whereupon it is evaporated in the space in the dewaxing furnace and discharged to the outside by means of a vacuum pump.

On the other hand, the resinous binder components which have comparatively high melting points are decomposed into gas in the bulk of the shaped article, with the resulting gas being rejected to the outside of said article by passage through the voids that have been left after the removal of the waxy component.

As described above, dewaxing under vacuum is effective in allowing the binder components to be positively discharged from the shaped article, so the latter can be dewaxed within a short period without deformation which would otherwise take place due to softening during dewaxing. In addition, by increasing the degassing capacity of the vacuum pump, a plurality of injection molded articles can be charged up to the full effective capacity of the dewaxing furnace.

In the practice of the process of the present invention, vacuum dewaxing is advantageously performed by heating the injection molded article in vacuo at a pressure of no higher than 1 Torr up to a temperature of 250°-500° C. at a rate of 5°-100° C./h until 40-95 wt % of the binder components are removed.

The conditions for vacuum dewaxing are limited in that way for the following reasons. First, if the dewaxing pressure exceeds 1 Torr, the aforementioned effects of vacuum dewaxing cannot be fully attained and the shaped article will blister or otherwise deform. Second, if the heating rate is less than 5° C./h, the dewaxing step requires too much time to serve industrial purposes. If the heating rate exceeds 100° C./h, the shaped article will soften and the binder will undergo decomposition into gases so rapidly that the shaped article will bulge, blister or otherwise deform. Thirdly, if the degree of dewaxing is less than 40 wt %, blistering or otherwise deformation may take place in the subsequent sintering step. Further, the sintering furnace may be contaminated by the residual binder. If the degree of dewaxing exceeds 95 wt %, the shaped article after dewaxing does not have a sufficient strength to prevent accidental breakage of the dewaxed body in the subsequent operations. In order to achieve dewaxing of 40-95 wt % with the binder of the present invention, the dewaxing temperature must be controlled in the range of 250-500° C. Because of these reasons, the conditions for vacuum dewaxing are specified in the manner already described above.

EXAMPLES

The following examples are provided for the purpose of further illustrating the present invention.

EXAMPLE 1

The components listed in Table 1 below were mixed together to prepare binder samples for powder shaping both within and outside the scope of the present invention. In order to investigate the characteristics of binder samples of the present invention and comparative samples, sinters were produced from injection molded articles in the manner described below.

Water-atomized powder of SUS 304L having a particle size of no more than 10 μm (average size=8.5 μm) were used as starting powder. To this starting powder, the binder samples of the present invention (see Table 1 under Nos. 1-7) were added in an amount of 9.0 wt % and the mixtures were homogenized by kneading with a pressurizing kneader at 170° C. for 1 h. The homogenized mixtures were processed into sheets with a roll mill and subsequently ground into particulate injection molding compounds having an average particle size of ca. 5 mm.

$$\text{Percent deformation of dewaxed article} = \frac{h_1 - h_1'}{h_1} \times 100$$

where $h_1$: a dimension of the shaped article $h_1'$: a dimension of the dewaxed article.

As Table 1 shows, the binder samples of the present invention allowed the dewaxed articles to deform by only a small degree (<1%), indicating that the deformation due to the self-weight of the shaped article was very small.

Using the binder of the present invention for powder shaping, shaped articles were also made from a WC-Co powder, a TiC-Ni powder, an Al-containing powder, an alumina powder and other powders, followed by dewaxing and sintering in the same manner as described above. Each of the sinters thus obtained retained their integrity in the absence of any cracking or otherwise deformation.

TABLE 1

| | | Composition (wt %) | | | | | | | | | | | Amount of | Percent |
|---|---|---|---|---|---|---|---|---|---|---|---|---|---|---|
| Run No. | | EVA | EEA | PP | APP | PS | PE | methacrylate ester copolymer | carnauba wax | paraffin wax | DBP | stearic acid | addition (wt %) | deformation of dewaxed article |
| Invention | 1 | 30 | — | 15 | — | 15 | — | — | 15 | 25 | — | — | 9.0 | 0.08 |
| | 2 | 20 | 10 | 15 | — | — | 15 | — | 20 | 20 | — | — | 9.0 | 0.12 |
| | 3 | 20 | — | 15 | 10 | 15 | — | — | 10 | 20 | 10 | — | 9.0 | 0.29 |
| | 4 | 15 | 15 | 15 | — | 15 | — | — | 10 | 20 | — | 10 | 9.0 | 0.21 |
| | 5 | 15 | 15 | — | 15 | — | 15 | — | 10 | 20 | 5 | 5 | 9.0 | 0.24 |
| | 6 | 20 | — | 20 | — | 10 | 10 | — | 20 | 20 | — | — | 9.0 | 0.13 |
| | 7 | — | 30 | 15 | — | 15 | — | — | 10 | 30 | — | — | 9.0 | 0.18 |
| Comparison | 8 | 30 | — | — | — | 20 | — | — | 15 | 35 | — | — | 9.0 | 12.72 |
| | 9 | 30 | 10 | 20 | — | — | — | — | 10 | 30 | 10 | — | 9.0 | 18.14 |
| | 10 | 30 | — | — | — | — | — | 20 | — | 40 | 10 | — | 9.0 | 23.88 |

Figure 2:
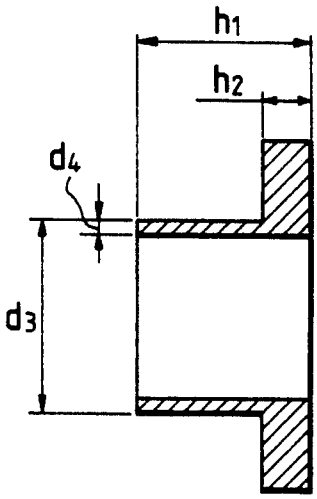
FIG. 2 is a cross-sectional view of the injection molded article shown in FIG. 1.

Those molding compounds were injection molded into shapes each consisting of the combination of a thin sheet and a cylinder as shown in FIG. 1 (front view) and FIG. 2 (cross-sectional view). Each shape had the following dimensions: $d_1=d_2=15$ mm; $d_3=8$ mm; $d_4=1$ mm; $h_1=7.5$ mm; and $h_2=2$ mm.

The thus shaped articles were placed on alumina plates and heated in $N_2$ atmosphere up to a temperature of 350° C. at a rate of 5° C./h until 70-80% of the binder components were removed. Thereafter, the dewaxed articles were sintered in vacuo at 1350° C. for 1 h to produce sinters.

The sinters were free from any cracking or deformation in the dewaxing and sintering steps and they had a relative density of 95% (of the theoretical) upon ca. 20% shrinkage from the shaped article (before sintering).

In order to demonstrate the effectiveness of the binders of the present invention for powder shaping, shaped articles were prepared from the same starting materials under the same conditions as described above using the comparative binder samples (see Table 1 under Nos. 8-10) that were added in the amounts also shown in Table 1. The thus shaped articles were dewaxed and the percentage deformation of each of those dewaxed articles was calculated for $h_1$ (see FIG. 2) by the following equation, with the data being also listed in Table 1. The same calculation was performed for the articles that were shaped in the presence of the binder samples of the present invention and that were subsequently dewaxed, with the data being listed in Table 1.

EXAMPLE 2

Other samples of injection molded article were sintered under the conditions shown in Table 2. The sinter samples produced by the method of the present invention are identified by Run Nos. 1-6 in Table 2 and the comparative samples are identified by Run Nos. 7 and 8.

Water-atomized powder of SUS 304L having an average particle size of 10 μm was used as starting powder. To this starting powder, a binder for injection molding was added and then kneaded, followed by forming with an injection molding machine into shapes each consisting of the combination of a thin sheet and a cylinder as shown in FIG. 1 (front view) and FIG. 2 (cross-sectional view). Each shape had the following dimensions: $d_1=18.2$ mm; $d_3=9.5$ mm; $h_1=9.3$ mm.

The shaped articles were heated in a nitrogen atmosphere for dewaxing 70-80 wt % of the binder components. Thereafter, the dewaxed articles were put into a vacuum sintering furnace and heated in vacuo (ca. $10^{-4}$ Torr) at a rate of 200° C./h to the temperatures shown in Table 2, whereupon argon gas was introduced into the furnace and the temperature was further raised to 1350° C. at a rate of 200° C./h. After holding at that temperature for 1 h, the resulting sinters were furnace-cooled.

Table 2 shows the carbon contents and weights of the thus obtained sinters. The higher the temperature at which the sintering atmosphere was replaced by argon, the smaller the carbon content and the lighter the weight. It can therefore be seen that in order to lower the carbon content of the sinter to 0.03 wt % and below, the sintering atmosphere need be heated to at least 1200° C. before it is replaced by argon.

Figure 3:
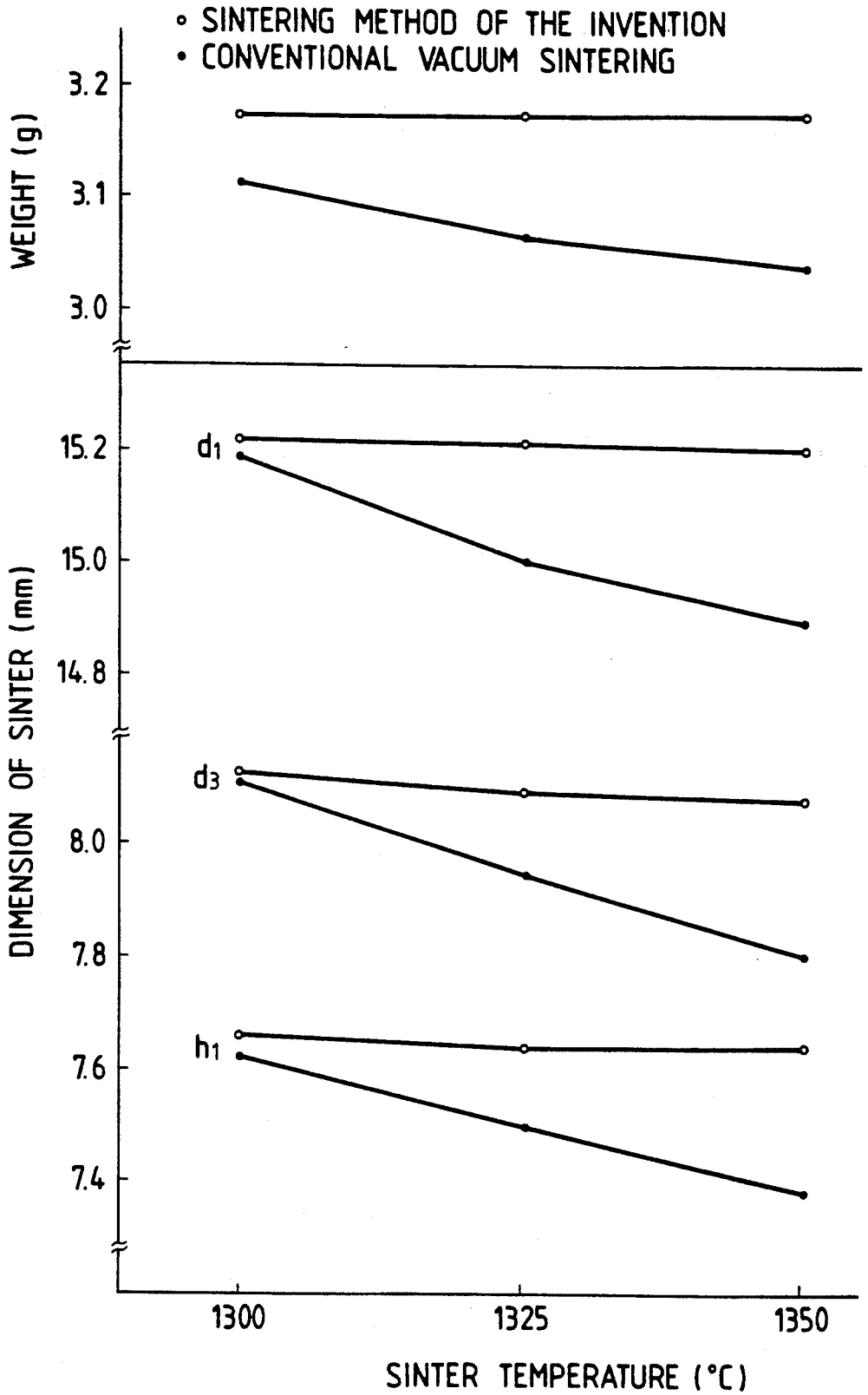
FIG. 3 is a graph comparing the sintering process of the present invention with the conventional vacuum sintering as regards the effect of sintering temperature on the dimensional and weight changes of a sinter.

The effect of the sintering temperature on the dimensions of the sinter is shown in FIG. 3 for the method of the present invention as compared with the conventional vacuum sintering. The weight change of the sinter is also shown in FIG. 3.

In accordance with the method of the present invention, dewaxed shaped articles were first heated in vacuo (ca. $10^{-4}$ Torr) up to 1200° C. and, then, the sintering atmosphere was shifted to an argon atmosphere, followed by heating to 1300° C., 1325° C. or 1350° C., at which temperatures the articles were held for 1 h and thereafter furnace-cooled. In the conventional vacuum sintering method, dewaxed articles were similarly heated in vacuo up to 1300° C., 1325° C. or 1350° C., at which temperatures they were held for 1 h and thereafter furnace-cooled. Symbols $d_1$, $d_2$ and $h_1$ denote the dimensions of those parts of the sinters which are identified by the same symbols in FIGS. 1 and 2.

As one can see from FIG. 3, the dimensions of the sinters produced by the conventional vacuum process changed greatly with the sintering temperature whereas the sinters produced by the method of the present invention experienced little of such dimensional changes with the sintering temperature. Further, a comparison with the change in the weight of the sinters clearly shows that the dimensional changes that occurred in the vacuum sintering method were caused by the evaporation of metal.

TABLE 2

| Run No. | | Sintering atmosphere | Temperature for argon substitution (°C.) | Carbon content of sinter (wt %) | Weight of sinter (g) |
|---|---|---|---|---|---|
| Invention | 1 | vacuo, | 1050 | 0.044 | 2.91 |
| | 2 | followed | 1100 | 0.036 | 2.83 |
| | 3 | by shift | 1150 | 0.032 | 2.84 |
| | 4 | to argon | 1200 | 0.025 | 2.80 |
| | 5 | atmosphere | 1250 | 0.019 | 2.76 |
| | 6 | | 1300 | 0.012 | 2.70 |
| Comparison | 7 | vacuo | — | 0.004 | 2.48 |
| | 8 | argon | — | 0.40 | 3.19 |

EXAMPLE 3

Water-atomized powder of SUS 304L having an average particle size of 8.5 μm was used as a starting powder. To this starting powder, binder sample No. 1 (see that consisted of 30 wt % EVA, 15 wt % PP, 15 wt % PE, 20 wt % paraffin wax and 20 wt % carnauba wax was added in an amount of 9.0 wt % and the mixture was homogenized by kneading with a twin-screw kneader at 170° C. for 1 h. Thereafter, the homogenized mixture was processed into a sheet on a roll mill and ground into a particulate injection molding compound having an average size of 5 mm.

This molding compound was injection molded into shapes each consisting of the combination of a thin sheet and a cylinder as shown in FIG. 1 (front view) and FIG. 2 (cross-sectional view).

The thus shaped articles were charged into a dewaxing furnace and dewaxed by heating up to 350° C. at a rate 50° C./h, with the furnace being evacuated to a pressure of ca. 0.01 Torr.

Subsequently, the dewaxed articles were put into a sintering furnace and heated up to 1200° C. at a rate of 200° C./h in vacuo of ca. $10^{-4}$ Torr. Then, the atmosphere in the furnace was replaced by argon gas and the articles were heated up to 1350° C. at a rate of 200° C./h, at which temperature they were held for 1 h to produce sinters.

The sinters thus obtained were free from any cracking or otherwise deformation and had a density that was at least 95% of the theoretical.

EXAMPLE 4

In order to demonstrate the effectiveness of vacuum dewaxing the binder used in the method of the present invention, shaped articles were prepared incorporating the binder compositions shown in Table 3 in the amounts also shown in that table; the shaped articles were dewaxed by heating up to 350° C. under the conditions shown in Table 3. Run Nos. 1–7 were in accordance with the method of the present invention, and Run Nos. 8–14 were comparative runs. The samples of Run Nos. 8 and 9 used binders outside the scope of the present invention; the sample of Run No. 10 was produced using the same binder as used in Run No. 1 but it was dewaxed at a heating rate outside the scope of the present invention; the samples of Runs Nos. 11–14 were produced using the same binder as used in Run No. 1 but they were dewaxed in a $N_2$ atmosphere under different conditions with respect to the amount of charge into the dewaxing furnace and the heating rate.

The percent deformation of each of the dewaxed articles was calculated as in Example 1 and the data are shown in Table 3 together with the percentage of acceptable pieces.

As is clear from Table 3, the deformation of the samples that were dewaxed by the method of the present invention was less than 0.1% and all of them were found acceptable in the substantial absence of deformation.

The comparative samples of Run Nos. 8 and 9 were entirely unacceptable since they experienced a high degree of deformation. The comparative sample of Run No. 10 was also entirely unacceptable in the presence of blisters that occurred on account of rapid decomposition of the binder into gases. The comparative samples of Run Nos. 11–14 were dewaxed in a $N_2$ atmosphere; when 100 pieces were charged into the dewaxing furnace and heated at a rate of 5° C./h, little deformation occurred and all of them were found acceptable (Run No. 11) but as the number of charges increased to 500 (Run No. 12) and 1000 (Run No. 13), more deformation occurred and the percentage of acceptable pieces decreased. When the heating rate was increased to 50° C./h (Run No. 14), deformation occurred so extensively that none of the pieces were found acceptable.

The shaped articles dewaxed by the method of the present invention (Run Nos. 1–7) were sintered as in Example 3 and the resulting sinters had high dimensional precision.

TABLE 3

| | | Binder composition (wt %) | | | | | | | | | |
|---|---|---|---|---|---|---|---|---|---|---|---|
| Sample No. | | EVA | EEA | PP | APP | PS | PE | paraffin wax | caunauba wax | DBP | methacrylate ester copolymer |
| Invention | 1 | 30 | | 15 | | | 15 | 20 | 20 | | |

TABLE 3-continued

| | | | | | | | | | | | |
|---|---|---|---|---|---|---|---|---|---|---|---|
| | 2 | 15 | 15 | 15 | | 15 | | 20 | 20 | | |
| | 3 | 20 | | | 20 | 10 | 10 | 30 | 10 | | |
| | 4 | | 20 | 10 | | | 10 | 40 | 20 | | |
| | 5 | 20 | | 10 | 10 | 20 | | 20 | 20 | | |
| | 6 | 20 | | 20 | | | 10 | 30 | 10 | 10 | |
| | 7 | 20 | | 10 | | | 20 | 20 | 20 | 10 | |
| Comparison | 8 | 30 | | | | | | 40 | | 10 | 20 |
| | 9 | 30 | | | | 15 | 15 | 30 | 10 | | |
| | 10 | 30 | | 15 | | | 15 | 20 | 20 | | |
| | 11 | 30 | | 15 | | | 15 | 20 | 20 | | |
| | 12 | 30 | | 15 | | | 15 | 20 | 20 | | |
| | 13 | 30 | | 15 | | | 15 | 20 | 20 | | |
| | 14 | 30 | | 15 | | | 15 | 20 | 20 | | |

| Sample No. | | Addition of binder (wt %) | Dewaxing atmosphere | Dewaxing heating rate (°C./h) | Dewaxing number of charges | Deformation of dewaxed article (%) | Percentage of acceptable pieces (%) |
|---|---|---|---|---|---|---|---|
| Invention | 1 | 9.0 | vacuo | 50 | 1000 | 0.00 | 100 |
| | 2 | 9.0 | vacuo | 50 | 1000 | 0.01 | 100 |
| | 3 | 9.0 | vacuo | 50 | 1000 | 0.00 | 100 |
| | 4 | 9.0 | vacuo | 50 | 1000 | 0.02 | 100 |
| | 5 | 9.0 | vacuo | 50 | 1000 | 0.01 | 100 |
| | 6 | 9.0 | vacuo | 50 | 1000 | 0.09 | 100 |
| | 7 | 9.0 | vacuo | 50 | 1000 | 0.08 | 100 |
| Comparison | 8 | 9.0 | vacuo | 50 | 10 | 8.75 | 0 |
| | 9 | 9.0 | vacuo | 50 | 10 | 4.64 | 0 |
| | 10 | 9.0 | vacuo | 150 | 10 | −3.27* | 0 |
| | 11 | 9.0 | $N_2$ | 5 | 100 | 0.08 | 100 |
| | 12 | 9.0 | $N_2$ | 5 | 500 | 1.63 | 70 |
| | 13 | 9.0 | $N_2$ | 5 | 1000 | 4.74 | 10 |
| | 14 | 9.0 | $N_2$ | 50 | 10 | 8.16 | 0 |

As described on the foregoing pages, the process of the present invention enables sinters to be produced without any cracking or otherwise deformation. In the dewaxing step, a plurality of shaped articles can be charged at close intervals into the dewaxing furnace and yet they are dewaxed without experiencing any deformation. Therefore, the quantity of charges into the dewaxing step can be increased while, at the same time, the heating rate for dewaxing can also be increased, thereby contributing to a substantial reduction in the cost for the dewaxing process.

Therefore, sinters that have complex three-dimensional shapes and that require high dimensional precision can be mass-produced in accordance with the present invention.

What is claimed is:

1. A process for producing a sinter, comprising the steps of:

mixing a powder with a binder;

injection molding said mixture to obtain an injection molded article;

dewaxing said injection molded article; and sintering the resulting dewaxed article, wherein said binder comprises at least one of:

5–40% by weight of an ethylene-vinyl acetate copolymer (EVA), an ethylene-ethyl acrylate copolymer (EEA), or mixture thereof;

5%–40% by weight of a polypropylene (PP), an atactic polypropylene (APP), or a mixture thereof;

5%–40% by weight of a polystyrene (PS), a polyethylene (PE), or mixture thereof;

20%–70% by weight of paraffin wax, carnauba wax, or a mixture thereof; and less than 15% by weight of a plasticizer selected from diethyl phthalate (DEP), dibutyl phthalate (EBP) and dioctyl phthalate (DOP), a lubricant selected from stearic acid and oleic acid, or mixture of said plasticizer and said lubricant; said dewaxing step comprises heating said injection molded article to a temperature of 250–500° C. and at a heating rate of 5°–100° C./hour under a pressure not higher than 1 Torr in order to remove 40–95% by weight of said binder components; wherein a elevation in said sintering step is started in a vacuum atmosphere and said atmosphere is replaced with an inert gas atmosphere during the temperature elevation.

2. A process for producing a sinter according to claim 1, wherein said powder is made of a metal material.

3. A process for producing a sinter according to claim 1, wherein said powder is made of a ceramic material.

4. A process for producing a sinter according to claim 1, wherein said inert gas is an Ar gas.

5. A process for producing a sinter which comprises the steps of:

mixing a powder with a binder;

injection molding said mixture to obtain a injection molded article;

dewaxing said injection molded article; and sintering the resulting dewaxed article, wherein said dewaxing step comprises heating said injection molded article to a temperature of 250–500 ° C. at a heating rate of 5°–100° C./hour under a pressure not higher than 1 Torr in order to remove 40–95% by weight of said binder components.

6. A process for producing a sinter according to claim 5, wherein a temperature elevation in said sintering step is started in a vacuum atmosphere and wherein said atmosphere is replaced with an Ar gas atmosphere in the process of temperature elevation.

7. A process for producing a sinter according to claim 5, wherein said binder comprises at least one of:

10–40% by weight of an ethylene-vinyl acetate copolymer (EVA), an ethylene-ethyl acrylate copolymer (EEA), or a mixture thereof;

10–40% by weight of a polypropylene (PP), an atactic polypropylene (APP), or a mixture thereof;

10–40% by weight of a polystyrene (PS), a polyethylene (PE), or a mixture thereof; and 20–50% by weight of paraffin wax, carnauba wax, or a mixture thereof.

8. A process for producing a sinter according to claim 7, wherein said binder further comprises less than 15% by weight of a plasticizer, a lubricant, or a mixture thereof.

9. A process for producing a sinter according to claim 5, wherein said binder is selected from the group consisting of:

5–40% by weight of an ethylene-vinyl acetate copolymer (EVA), an ethylene-ethyl acrylate copolymer (EEA), or mixture thereof;

5–40% by weight of a polypropylene (PP), an atactic polypropylene (APP), or a mixture thereof;

5–40% by weight of a polystyrene (PS), a polyethylene (PE), or a mixture thereof;

20–70% by weight of paraffin wax, carnauba wax, or a mixture thereof; and less than 15% by weight of a plasticizer selected from diethyl phthalate (DEP), dibutyl phthalate (EBP) and dioctyl phthalate (DOP), a lubricant selected from stearic acid and oleic acid, or a mixture of said plasticizer and said lubricant.

* * * * *